US005131384A

United States Patent [19]

Obagi

[11] Patent Number: 5,131,384

[45] Date of Patent: Jul. 21, 1992

[54] COMBINATION APPLICATOR/MASSAGER

[76] Inventor: Zein E. Obagi, 444 Camden Dr., Beverly Hills, Calif. 90210

[21] Appl. No.: 704,869

[22] Filed: May 23, 1991

[51] Int. Cl.[5] ..... A61H 15/00

[52] U.S. Cl. ..... 128/57; 128/64; 401/28

[58] Field of Search ..... 128/64, 66, 57; 401/28

[56] References Cited

U.S. PATENT DOCUMENTS

| | | | |
|---|---|---|---|
| 2,285,105 | 6/1939 | Bacher | 128/65 |
| 3,754,548 | 8/1973 | McGrath | 128/65 |
| 3,994,290 | 11/1976 | Springer | 128/65 |
| 4,037,977 | 7/1977 | Ronai | 401/209 |
| 4,326,508 | 4/1982 | Stauffer | 128/57 |
| 4,469,094 | 9/1984 | Kaeser | 128/65 |
| 4,492,223 | 1/1985 | Burke | 128/57 |
| 4,811,726 | 3/1989 | Goncalves et al. | 128/57 |
| 4,823,777 | 4/1989 | Goncalves et al. | 128/57 |
| 4,858,600 | 8/1989 | Gross | 128/65 |

FOREIGN PATENT DOCUMENTS

| | | | |
|---|---|---|---|
| 1237263 | 3/1967 | Fed. Rep. of Germany | 128/65 |
| 3430877 | 3/1986 | Fed. Rep. of Germany | 128/66 |

*Primary Examiner*—Robert A. Hafer
*Assistant Examiner*—David J. Kenealy
*Attorney, Agent, or Firm*—Brown, Martin, Haller & McClain

[57] ABSTRACT

A combination applicator/massager device is described for simultaneous application of a fluid to an area of a person's skin and massage of that area of skin. The device contains a reservoir for containment and dispensing of the fluid, the reservoir forming a hollow chamber open at one end; a ball retainer having ball-seating recesses therein; a dispensing or metering plate fitting within and substantially closing the open end of the reservoir, with fluid conduits in the plate permitting liquid communication between each recess and the chamber; a spherical ball seated in and freely rotatable within each the recess; and cooperating securing threads or the like to removably secure the retaining means to the reservoir with the plate disposed therebetween and with each ball retained for free rotation in its recess; whereby fluid contained in the reservoir can flow through the conduits into the recesses and onto the surface of the balls and by rotation of the balls the fluid will be transferred to the person's skin when the ball is brought into massaging contact with the person's skin. The balls preferable have textured surfaces for improved liquid retention. Interchangeable balls, retainers and plates can be used to provide optimum dispensing of liquids of different compositions and viscosities.

8 Claims, 2 Drawing Sheets

COMBINATION APPLICATOR/MASSAGER

BACKGROUND OF THE INVENTION

I. Field of the Invention

This invention relates to devices for applying fluids such as medicated lotions to the human skin and also to devices for massaging the skin.

II. Description of the Prior Art

For many years people have found comfort and therapeutic benefit in having their skin massaged and various types of medicinal lubricating and moisturizing fluids applied to the skin. While such lotions and massaging can be applied manually, numerous types of devices have been provided to accomplish such lotion application and massaging mechanically.

While most such devices have been intended for either fluid application or massaging, but not both, there have been several types of devices which have been described which are intended to accomplish both simultaneously. Such devices have heretofore had highly complex internal structures, usually intended to regulate fluid flow or to regulate dispensing of different materials for application to the skin, or have been hybrid devices in which different components perform the massaging and applicating functions. Typical of such devices are those shown in U.S. Pat. Nos. 4,811,726 and 4,823,777, which disclose a device with a complex two-part obturator for controlling the dispensing of liquids or pastes; U.S. Pat. No. 4,037,977, which discloses a compartmented device with control means for dispensing one or more different materials for application; and U.S. Pat. No. 4,326,508, which describes a dispensing device which is mounted centrally of a separate massaging device.

All of these devices suffer from deficiencies. The devices with complex interior structures are difficult to assemble, refill, clean and maintain in optimum operating condition. Those devices in which the massaging and liquid dispensing functions are separated are difficult to use and do not ensure that the massaging of the skin will occur on those portions of the skin to which lotion or other liquid has been applied.

It would therefore be advantageous to have a device which is simple in structure, readily assembled and disassembled, and can be easily cleaned. In addition, the device should be such that the user can be assured of having his or her skin massaged at precisely the same points at which skin lotion is being applied.

SUMMARY OF THE INVENTION

In its broadest form, the invention herein is a combination applicator/massager device for simultaneous application of a fluid to an area of a person's skin and massage of the area of skin, which devices comprises reservoir means for containment and dispensing of the fluid comprising a base and side enclosing a hollow chamber open at one end, and having support means at the open end; plate means fitting within and substantially closing the open end of the reservoir means and held in position by engagement with the support means, the plate means having conduit means therein means permitting liquid communication between each recess and the hollow chamber; retainer means having at least one generally spherical recess therein and means associated therewith to retain a spherical ball in the recess; a spherical ball seated in each recess and freely rotatable within the recess; and cooperating securing means on the side of the reservoir and the retaining means such that the retaining means can be removably secured to the reservoir with the plate means disposed therebetween and with the ball retained for free rotation between the recess and the aperture; whereby fluid contained in the reservoir can flow through the conduit means into the recess and onto the surface of the ball and by rotation of the ball the fluid will be carried into position external of the retainer means, there to be transferred to the person's skin when the ball is brought into massaging contact with the person's skin.

In preferred embodiments the device will be generally cylindrical in shape and will have a plurality of balls, generally 5-8, arranged across the bearing surface of the device.

DETAILED DESCRIPTION OF THE PREFERRED EMBODIMENTS

The device of the present invention is best understood by reference to the drawings.

Figure 1:
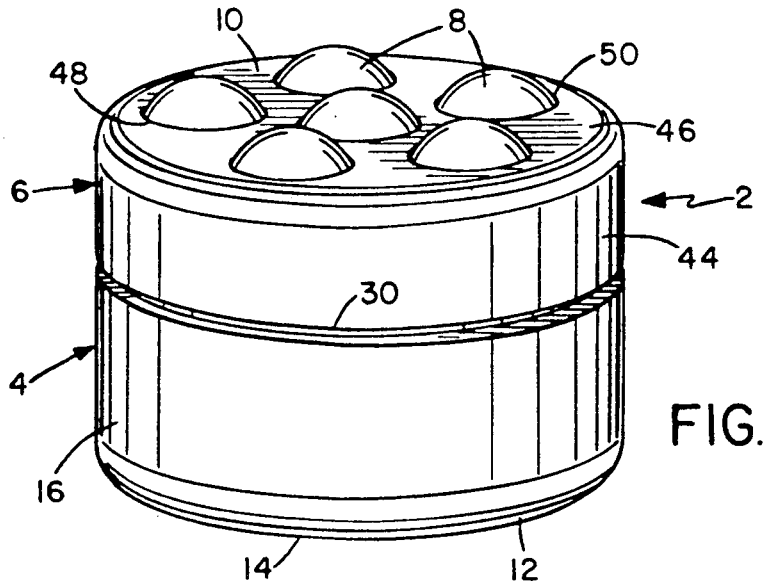
FIG. 1 is a perspective view of an applicator/massager device of the present invention.
Figure 3:
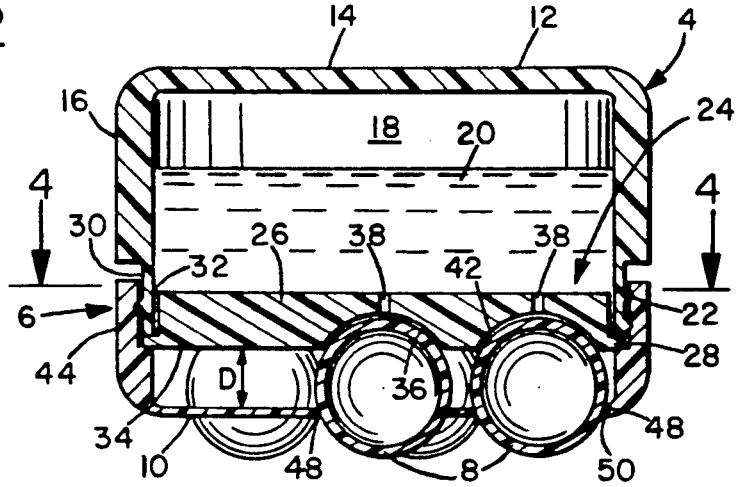
FIG. 3 is a cross-sectional view taken on line 3—3 of FIG. 2.

FIG. 1 shows an overall perspective view of one embodiment of the device 2 as viewed from the side. Visible in FIG. 1 are the outside of the reservoir 4, the retainer 6 and the applicator balls 8. Since in normal use the device will be positioned with the balls 8 facing generally downward, as illustrated in FIG. 3, for convenience herein the retainer 6 will be considered to be at the bottom of the device and the reservoir 4 at the top, with surfaces 10 and 12 representing respectively the "bottom" and "top" of the device. It will be noted, however, that for storage one will normally stand the device on its "top" 12 (as shown in FIG. 1) so that the liquid 20 in chamber 18 of reservoir 4 not be able to leak from the reservoir 4.

FIG. 3 illustrates the internal structure of the device. The reservoir 4 is made up of a base 14 including the bottom surface 12 and a side wall 16. Side 16 and base 14 are joined together to form a hollow vessel having an open interior chamber 18 which serves as a reservoir for fluid 20. In the embodiment shown there is only a single side 16 which is in the form of an open cylinder and which in combination with base 14 forms a cylindrical reservoir. This shape is most preferred because it forms a device which can easily be held in the user's hand. In addition, since the device in cross-section is circular, screw threads 22 can easily be formed in the surface to form a screw coupling with the retainer 6 for easy assembly and disassembly of the device. It will be understood, however, that other shapes such as cubical, rectangular, oval or the like may also be used, with coupling means between reservoir 4 and retainer 6 being adapted accordingly, and with the respective number of walls 16.

The upper end of reservoir 4 is open as indicated at 24 and the open end is substantially entirely closed by fluid metering plate 26. Plate 26 is circular and is surrounded at its upper end by circumferential flange 28. Flange 28 rests on the upper end of collar 30 which extends upwardly as an extension of side wall 16 of reservoir 4. As shown, plate 26 is slightly smaller in diameter than the open end 24 of reservoir 4, producing a narrow annular gap 32 between the inside surface of collar 30 of wall 16 and the outer edge of plate 26 below flange 28. The presence of annular gap 32 makes it easy for the user to disassemble the device for cleaning and refilling. However, if desired a resilient sealing material (in the form perhaps of an O-ring mounted in a circumferential groove on plate 26) could be present. Similarly, one could if desired have an annular gasket disposed between flange 28 and collar 30.

Figure 2:
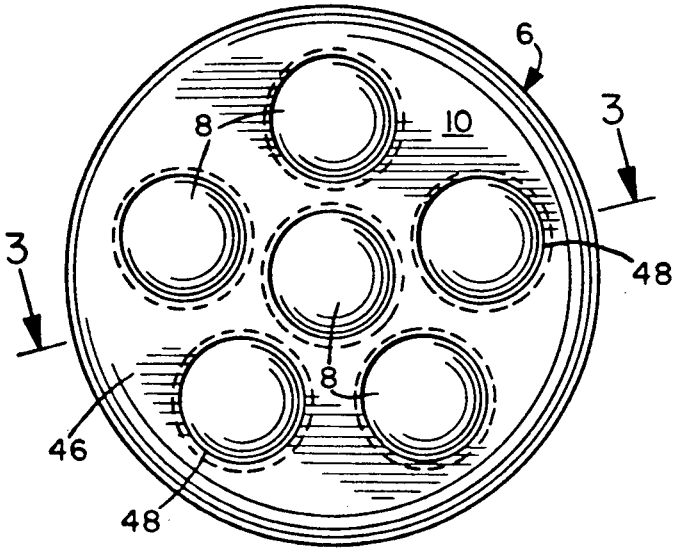
FIG. 2 is a plan view of the roller face of the device of FIG. 1.
Figure 6:
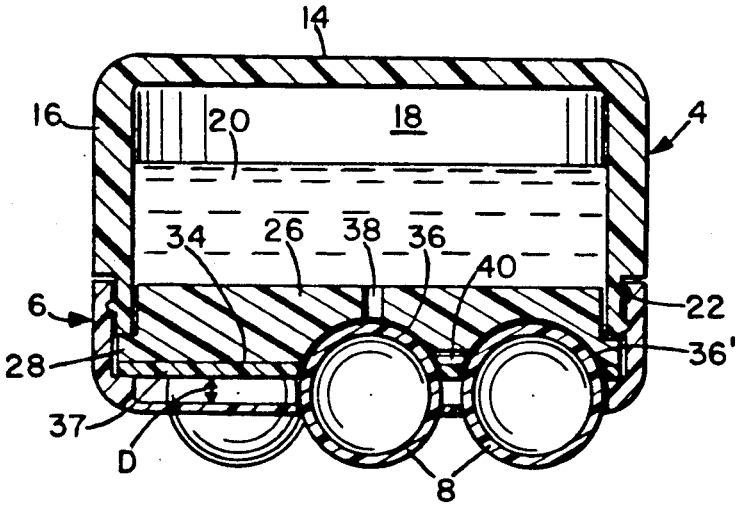
FIG. 6 is a cross-sectional view similar to that of FIG. 3 of an embodiment of the device incorporating the ball supporting plate of FIG. 5.

In one alternative embodiment (as shown in FIGS. 3 and 6), plate 26 serves as the ball seat. In this embodiment at least one spherical recess 36 is formed in the surface 34 opposite the chamber 18. ("Spherical" in this context means that the recess's surface conforms to a portion of the surface of a sphere, not that the recess forms a complete sphere.) The recesses 36 may be in any convenient pattern which provides for free rotation of the balls 8, each of which is seated in a separate recess 36, and keeps them from interfering with each other. A typical pattern for six balls is shown in FIG. 2. It will be evident that there can be more or less balls and that they can be distributed in other patterns across the surface 34 of plate 26. The particular number of balls used is not critical to the functioning of this invention, although the use of five to eight balls, with one centrally of the others as generally shown in FIG. 2, has been found to be quite satisfactory.

Figure 4:
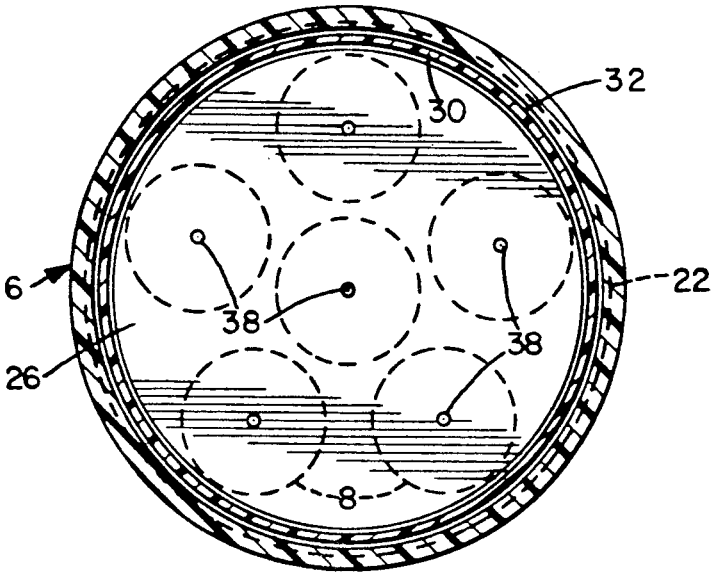
FIG. 4 is a cross-sectional view taken on line 4—4 of FIG. 3.

Also within plate 26 is at least one conduit 38 providing fluid communication for liquid 20 between chamber 18 and recess 36. In the embodiment shown in FIGS. 3 and 4, each recess 36 has its own conduit 38 communicating directly with the fluid in chamber 18.

Figure 5:
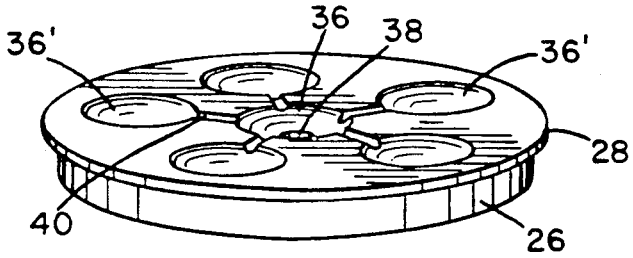
FIG. 5 is a perspective view of one alternative configuration of a retaining structure for an applicator ball.

In an alternative form, shown in FIGS. 5 and 6, plate 26 has only a single conduit 38 between central recess 36 and the radially-disposed recesses, here indicated as 36'. Formed in the surface 34 of plate 26 are radially-extending channels 40 connecting each of the radially-disposed recesses 36' with the central recess 36, such that fluid 20 entering recess 36 through conduit 38 can flow outwardly through each channel 40 to the recesses 36'. In this embodiment it will be necessary to have rigid gasket 37 placed in contact with surface 34 to cover each of the channels 40 and direct the liquid 20 to the recesses 36', as shown in FIG. 6.

Figure 9:
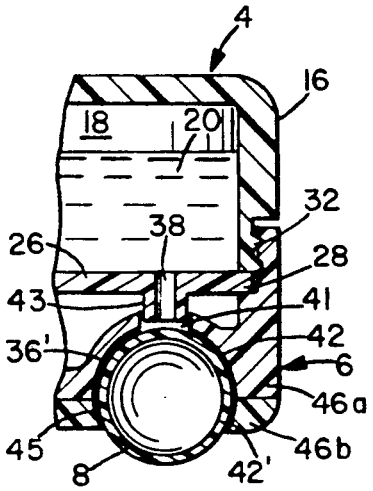
FIG. 9 is a sectional detail view of another alternate retaining structure for an applicator ball.

In the alternative embodiment shown in FIG. 9, plate 26 serves only to dispense or meter the fluid 20 through conduits 38. The balls 8 are retained in position by a two-piece version of retainer 6, in which the inner half of the top is designated **46*a* and the outer half is designated 46*b*. The top surface 10 is then part of half 46*b*. Recesses 38 are formed in the half 46*a* which are in the form of hemispheres 36'. The balls 8 seated in hemispheres 36' are then retained by apertures 45 formed in half 46*b*, which have a curvature comprising a small portion of a spherical surface, so that when placed in contact with half 46*a*, the apertures 45 of half 46*b* cooperate with the recesses 36' to surround more than 180° of each ball 8 and retain the balls 8 in place. The balls 8 still are still spaced slightly away from the surfaces of hemispheres 36' and apertures 45 to form clearances 42 and 42' for the flow of the fluid 20. In this embodiment the conduits 38 are in the form of elongated nipples 43 which penetrate into apertures 41 in those portions of half 46*a* forming recesses 36'**.

The fluid 20 retained in chamber 18 may be any type of liquid which it is desired to apply to the user's skin. Such would include various types of lotions, medications, oils, lubricants, moistening agents or emollients. Such liquids will have a viscosity sufficient to permit the liquid to flow through the device in a controlled manner, so that there will be adequate flow to the applicator balls and the flow will be neither too rapid nor too sluggish. Many such liquids are now known and many others with similar properties will be available in the future, so that those skilled in the art will have no problem identifying appropriate liquids. It is intended that all such liquids may be used in the device of this invention, subject only to their compatibility with the materials from which the device may be made.

In addition, it will be recognized that the conduits 38 and channels 40 can be sized so as to accommodate liquids with generally greater or lesser viscosity, by providing the requisite degree of fluid flow. Also a single device may be made useful for several different viscosity classes of liquids, simply by providing a plurality of different plates 26, each of which has a different size of conduit 38 and/or channel 40. Thus the device could be vended as a set, with a single reservoir 4 and retainer 6 but with two or more different plates 26 for use with different liquids.

Figure 7:
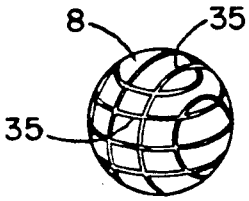
FIGS. 7 and 8 are perspective views of two different embodiments of balls useful in this device.
Figure 8:
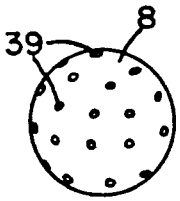

As noted, each of the balls 8 will be seated in its recess 36 such that it may rotate freely with a small amount of clearance 42 such that the fluid 20 may flow across the surface of recess 36 and be in contact with the surface of ball 8. In order to enhance the pickup of liquid 20 by the surface of ball 8, the ball surface may be textured, as with grooves 35 as shown in FIG. 7 or dimples 39 as shown in FIG. 8.

The balls 8 are held in position by the one- or two-piece retainer 6, which is formed with a side wall 44 and a top 46 which includes top surface 10. Thus the device can be assembled or disassembled simply by a conventional twisting motion, so that the entire device becomes separated into its individual components for cleaning, substitution of alternate components, or replacement of damaged or worn parts. Other types of closure means, such as clamps or screws, can also be used, and the simple modifications to the structure of reservoir 4 and retainer 6 will be evident to those skilled in the art. Formed in the top 46 of retainer 6 are apertures 48. Each of the apertures 48 is of a diameter smaller than the diameter of a ball 8, such that when the retainer 6 is placed in position a portion of each ball 8 projects outwardly through each aperture 48 but the entire ball is retained in its rotatable position seated in recess 36, such that the balls 8 cannot be dislodged from the device. The spacing D of the inside of retainer top 46 and plate surface 34 is selected along with the size of aperture 48 such that a small annular gap 50 can exist between the outer surface of each ball 8 and the edge its aperture 48. Thus when the device is being used and the balls 8 are forced inwardly toward plate 26 by the weight of the device and the pressure of the user's hand, fluid 20 on the surface of balls 8 can be carried outwardly on the surface of each ball 8 and into contact with the user's skin for transfer onto the skin. It will be evident that the length of dimension D will determine how deep each recess 36 needs to be in plate 26, and consequently how thick plate 26 needs to be, for each particular configuration. Comparison of FIGS. 3 and 6 will illustrate two typical configurations.

The device of the present invention may be made of any convenient material or combination of materials. For instance, the reservoir 4, plate 26 and retainer 6 may be made of metal such as aluminum or stainless steel or of a hard plastic material, such as an ABS or phenolic polymer or a hard rubber material. The balls will often be of a softer plastic material, such as polyethylene or polypropylene. It is desirable to have the surface of the balls be of a material which has an affinity for the base composition of the liquid 20, to enhance the ability of the ball surfaces to pick up the liquid 20 and transfer it to the user's skin. Since the device can be easily disassembled and reassembled, it would be quite practical to have two sets of balls, one made of an oliophilic material for use with oil-based liquids and the other set made of a hydrophilic material for use with water-based liquids. These can be readily interchanged by the user to provide for optimum efficiency of the device.

It will be evident from the above description that the balls 8 can not only rotate freely between the retainer 6 and the recesses 36, but that in addition the spacing of the distance D allows for a small amount of vertical and lateral motion of the balls 8, which enhances the massaging effect as the user moves the device around on his or her skin.

The device of this invention may be of any size which will hold a significant amount of fluid 20 and which can easily be held in the user's hand for manipulation by the user. Commonly the device will be about 2½-3½ inches (6.4-8.9 cm) in diameter and about 2-3 inches (5.1-7.6 cm) in height, with each of the balls being approximately ½-¾ inch (1.3-1.9 cm) in diameter. Smaller devices can be constructed by reducing the number of balls and their size and conversely larger devices may be constructed for massaging and applying liquid to larger skin surfaces such as a person's back. With the larger devices it is preferable to retain the balls at the size of approximately inch ½-¾ inch (1.3-1.9 cm) and simply increase the number of balls in proportion to the size of the device, rather than having a small number of larger balls, since the use of more small balls provides for greater efficiency in applying and distributing the liquid to the skin's surface.

It will be evident that there are numerous embodiments of this invention which, while not specifically illustrated or described, are clearly within the scope and spirit of the invention. Consequently the above description is intended to be exemplary only, and the scope of the patent is to be limited solely by the appended claims.

I claim:

1. A combination applicator/massager device for simultaneous application of a fluid to an area of a person's skin and massage of said area of skin, which comprises:

reservoir means for containment and dispensing of said fluid comprising a base and side enclosing a hollow chamber open at one end, and having support means at said open end;

plate means fitting within and substantially closing said open end of said reservoir means and held in position by engagement with said support means, said plate means having at least one generally spherical first recess therein;

retainer means having at least one generally spherical second recess therein, an aperture in said second recess, and means associated therewith to retain a spherical ball seated with a portion in each of said recesses and a portion projecting outwardly through said aperture;

conduit means through said plate means permitting continually unrestricted liquid communication between each said first recess and said hollow chamber;

a spherical ball seated with a portion in each said first and second recess, a portion projecting outwardly through said aperture, and freely rotatable within said recesses; and cooperating securing means between said reservoir and said retainer means such that said retainer means can be removably secured to said reservoir with said plate means disposed therebetween and with said ball retained for free rotation within said recesses and said aperture;

whereby fluid contained in said reservoir can flow through said conduit means into said first recess and onto the surface of said ball and by rotation of said ball at said aperture said fluid will be carried into position external of said retainer means, there to be transferred to said person's skin when said ball is brought into massaging contact with said person's skin.

2. A device as in claim 1 wherein said conduit means comprises at least one hole in said plate means, each said hole communicating between the reservoir and one of said at least one first recesses.

3. A device as in claim 2 wherein there are a plurality of said first recesses and each said first recess has associated therewith an individual one of said holes.

4. A device as in claim 2 wherein said plate means contains a plurality of said first recesses, said conduit means comprises a single hole, said single hole communicating between said reservoir side of said plate means and a single one of said first recesses, and further comprises at least one channel in the surface of said plate means, said channel providing fluid communication between said one first recess containing said hole and another first recess.

5. A device as in claim 1 wherein there are a plurality of said balls.

6. A device as in claim 5 wherein each ball in said plurality has a textured surface.

7. A device as in claim 1 wherein said retainer means and said reservoir means are generally cylindrical in form and said securing means comprises a releasable threaded closure.

8. A device as in claim 1 further comprising a plurality of said plate means, each plate means within said plurality having a different size of conduit means, with said plate means interchangeable such that different ones of said plate means in said plurality may be disposed in said device to accommodate fluids in said reservoir of different viscosities.

* * * * *